US008267664B2

(12) United States Patent
Tipton et al.

(10) Patent No.: US 8,267,664 B2
(45) Date of Patent: Sep. 18, 2012

(54) AXIAL COMPRESSOR BLADE RETENTION

(75) Inventors: Thomas R. Tipton, Greer, SC (US); Mark Newton, Mauldin, SC (US)

(73) Assignee: General Electric Company, Schenectady, NY (US)

( * ) Notice: Subject to any disclaimer, the term of this patent is extended or adjusted under 35 U.S.C. 154(b) by 1202 days.

(21) Appl. No.: 12/078,758

(22) Filed: Apr. 4, 2008

(65) Prior Publication Data

US 2009/0252611 A1 Oct. 8, 2009

(51) Int. Cl.
*F01D 5/30* (2006.01)
*F01D 5/32* (2006.01)

(52) U.S. Cl. ..... 416/221; 416/220 A; 416/248

(58) Field of Classification Search ..... 416/220 A, 416/220 R, 221, 219 R, 248, 500
See application file for complete search history.

(56) References Cited

U.S. PATENT DOCUMENTS 929,234 A * 7/1909 Mather ..... 301/12.1
2,944,467 A * 7/1960 Casanov ..... 409/242
3,425,305 A * 2/1969 Cocco ..... 82/161
3,567,337 A * 3/1971 Zerlauth et al. ..... 16/221
3,986,779 A * 10/1976 Beckershoff ..... 403/20
4,462,756 A * 7/1984 Muggleworth et al. ..... 416/215
4,655,687 A * 4/1987 Atkinson ..... 416/193 A
4,818,182 A * 4/1989 Bouru ..... 416/215
5,638,604 A * 6/1997 Lorocco ..... 42/132
6,016,608 A * 1/2000 Lorocco ..... 33/265
6,384,992 B1 * 5/2002 Weiss ..... 359/819

OTHER PUBLICATIONS

U.S. Appl. No. 12/007,509, filed Jan. 10, 2008.

* cited by examiner

*Primary Examiner* — Edward Look
*Assistant Examiner* — Sean J Younger
(74) *Attorney, Agent, or Firm* — Nixon & Vanderhye, P.C.

(57) ABSTRACT

An axial retention system for restraining axial movement of a machine component having a dovetail within a complimentary-shaped dovetail slot includes: a first substantially T-shaped groove formed in a bottom surface of the dovetail slot; a second substantially T-shaped groove formed in a bottom surface of the dovetail, the first and second grooves in alignment when the dovetail is located within the dovetail slot to thereby form a closed periphery substantially T-shaped slot having a stem portion and a lateral cross portion at one end of the stem component, wherein the other end of the stem is open; and a compressible locking clip adapted for insertion within the substantially T-shaped slot, the locking clip having a pair of oppositely extending lugs receivable in opposite ends of the lateral cross portion.

20 Claims, 4 Drawing Sheets

AXIAL COMPRESSOR BLADE RETENTION

This invention relates generally to turbomachinery and, more particularly, to the retention of blades or buckets within slots formed in a compressor rotor blade wheel.

BACKGROUND OF THE INVENTION

In a conventional turbine compressor component, rotor blades are held in a rotor blade wheel by means of a dovetail connection, i.e., a dovetail on the blade is received in a complimentary dovetail slot in the wheel.

The fit between the blade and the dovetail slot in the rotor wheel is loose to allow for assembly and tolerances. Therefore, if the blades are not properly retained, the loose fit may allow the hardware to move in the slot, leading to excessive wear. The excessive wear could eventually fail the part, requiring the unit to be shut down until a repair can be made.

Typically, each rotor blade is retained in the blade wheel to limit motion along the ring dovetail slot by one or more stakes. This is a process where material at the edge of the wheel slot is plastically deformed and displaced into a void created by a local chamfer of the blade dovetail. This is a manual and highly variable process which can in some cases provide inadequate retention of the rotor blade in the rotor wheel slot. Vibratory forces acting on the rotor can produce wear on the stake leading to eventual failure of the retention feature. Once the stake is worn, the blade can then slide freely in the wheel slot. At very high amplitudes, this motion can lead to wearing of the blade dovetail and eventual failure. This could then lead to blade liberation and subsequent collateral damage to the gas turbine. There have also been many documented instances of rotor blades being installed incorrectly by, for example, inserting the blade in the wheel slot backwards. Some of these mis-assemblies have been identified as causes of subsequent failure of machine equipment.

There remains a need for a field-retrofittable blade retention mechanism that will allow the blade to be installed, removed and reinstalled without damaging the blades or the wheel.

BRIEF DESCRIPTION OF THE INVENTION

In an exemplary, non-limiting implementation, the invention relates to an axial retention system for restraining axial movement of a machine component having a dovetail within a complimentary-shaped dovetail slot comprising: a first substantially T-shaped groove formed in a bottom surface of the dovetail slot; a second substantially T-shaped groove formed in a bottom surface of the dovetail, the first and second grooves in alignment when the dovetail is located within the dovetail slot to thereby form a closed periphery substantially T-shaped slot having a stem portion and a lateral cross portion at one end of the stem component, wherein the other end of the stem is open; and a compressible locking clip adapted for insertion within the substantially T-shaped slot, the locking clip having a pair of oppositely extending lugs receivable in opposite ends of the lateral cross portion.

In another aspect, the invention relates to an axial retention system for restraining axial movement of a turbine blade having a dovetail within a complimentary-shaped dovetail slot in a turbine rotor wheel comprising: a first substantially T-shaped groove formed in a bottom surface of the dovetail slot; a second substantially T-shaped groove formed in a bottom surface of the dovetail, the first and second grooves in alignment to thereby form a closed periphery substantially T-shaped slot having a stem portion and a lateral cross portion at one end of the stem component, wherein the other end of the stem is open; and a compressible locking clip inserted within the substantially T-shaped slot, the locking clip having a pair of oppositely extending lugs received in opposite ends of the lateral cross portion.

In still another aspect, the invention relates to an axial retention system for restraining axial movement of a turbine blade having a dovetail within a complimentary-shaped dovetail slot in a turbine rotor wheel comprising: a first substantially T-shaped groove formed in a bottom surface of the dovetail slot; a second substantially T-shaped groove formed in a bottom surface of the dovetail, the first and second grooves in alignment to thereby form a closed periphery substantially T-shaped slot having a stem portion and a lateral cross portion at one end of the stem portion, wherein the other end of the stem is open; a compressible locking clip inserted within the substantially T-shaped slot, the locking clip having a pair of oppositely extending lugs connected by a substantially C-shaped loop portion and received in opposite ends of the lateral cross portion, and wherein the compressible locking clip is sized to allow compression of the loop portion such that the oppositely extending lugs can pass through the stem portion and expand into the opposite ends of the lateral cross portion.

The invention will now be described in connection with the drawings identified below.

DETAILED DESCRIPTION OF THE INVENTION

Figure 1:
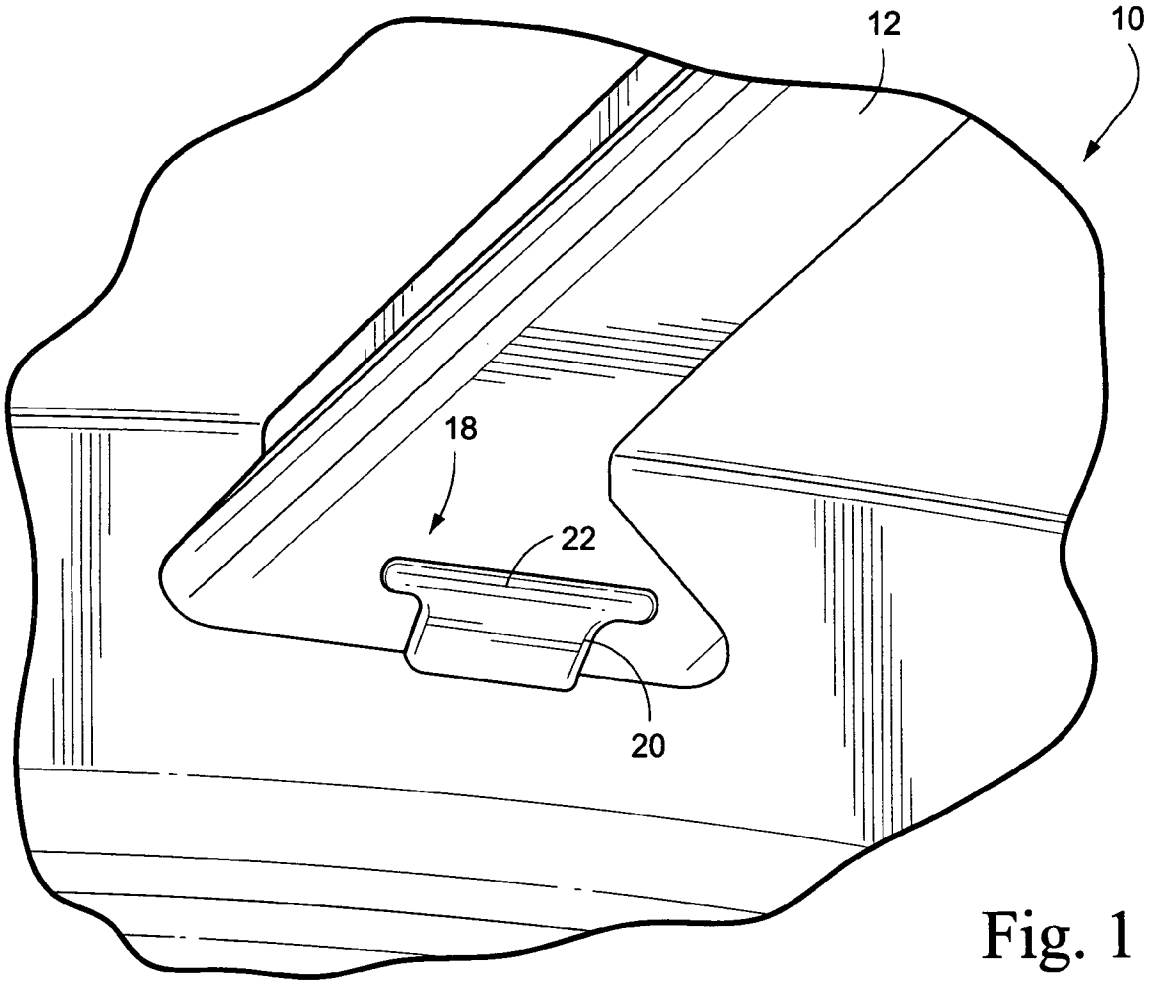
FIG. 1 is a partial perspective view of a T-shaped clip retention groove in a rotor wheel dovetail slot in accordance with an exemplary but non-limiting embodiment.

FIG. 1 illustrates a compressor rotor wheel 10 formed with a plurality of dovetail slots 12 (one shown) circumferentially spaced about the periphery of the wheel. Each slot 12 is designed to receive a complimentary dovetail 14 (FIG. 2) of the root of a blade or bucket 16.

The dovetail slot 12 in the wheel 10 is shown in FIG. 1 without the blade 16, thus permitting a view of a first T-shaped groove 18 machined into the base of the dovetail slot, with a stem portion 20 of the groove opening at the edge of the slot, and a lateral cross portion 22 of the groove located remote from the slot edge. In the illustrated embodiment, the groove 18 has radiused edges and a depth that accommodates approximately one-half the periphery of a retention spring clip described further below.

Figure 2:
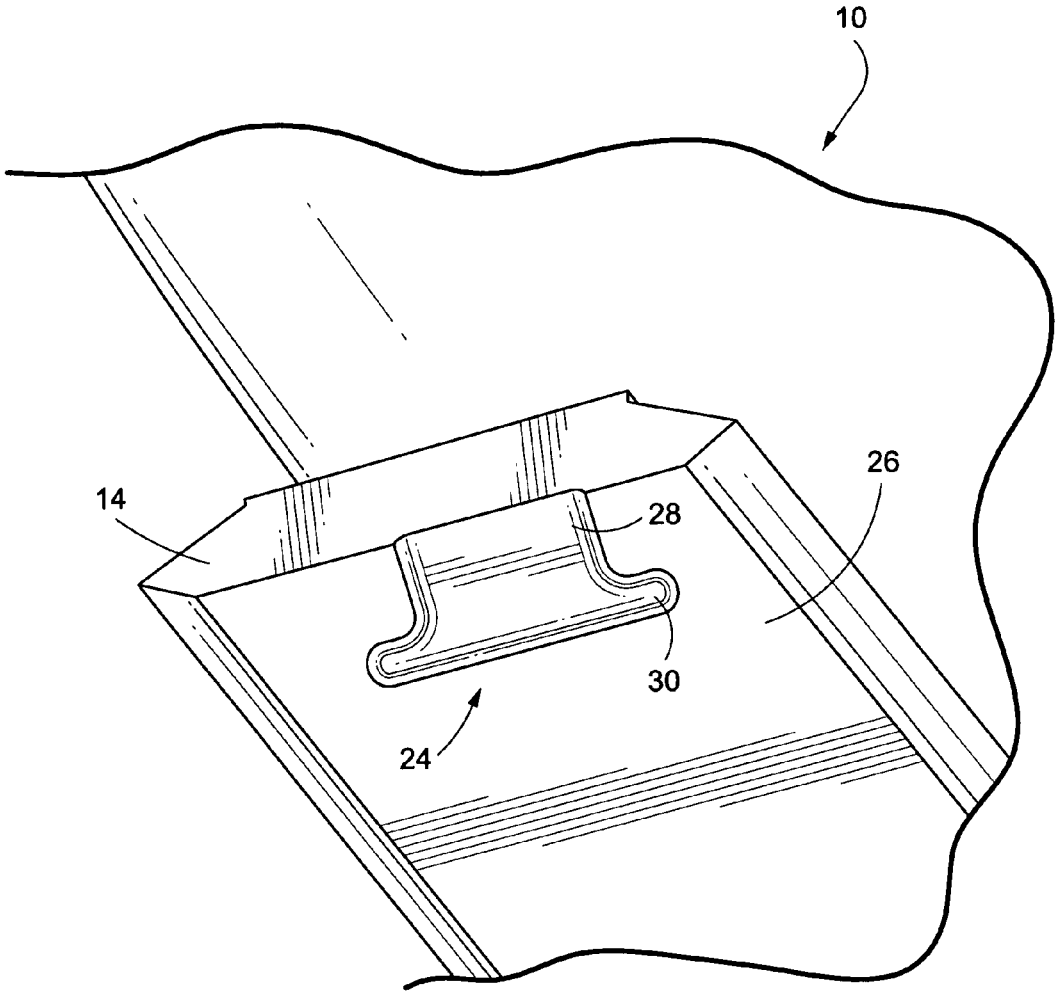
FIG. 2 is a partial perspective view of a complimentary T-shaped groove in a rotor blade dovetail.

FIG. 2 illustrates a second T-shaped groove 24 machined in the underside surface 26 of the blade dovetail 14, located so as to precisely align with the first T-shaped groove 18 in the dovetail slot 12 when the blade 16 is properly located within the slot 12. The second T-shaped groove 24 has a stem portion 28 and a lateral cross portion 30, with similarly radiused edges and a depth accommodating half of the spring clip, such that when grooves 18, 24 are aligned, they form a closed-periphery T-shaped slot 29 (FIGS. 4 and 5), with the free ends of the stem portions 20, 28 opening at the edge of the rotor wheel dovetail groove 12. The lateral cross portions 22, 30 assume a substantially cylindrical cross section at their respective opposite ends for receiving correspondingly shaped projections on the retention clip as described further below. The relative depths of the first and second T-shaped grooves need not be equal, and may vary within a functionally acceptable range.

Figure 3:
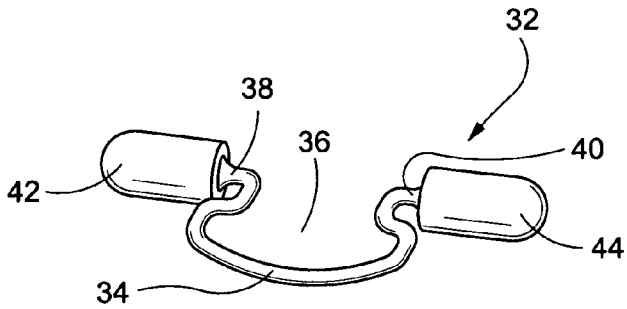
FIG. 3 is a perspective view of a retention clip to be inserted into aligned T-shaped grooves as shown in FIGS. 1 and 2.
Figure 4:
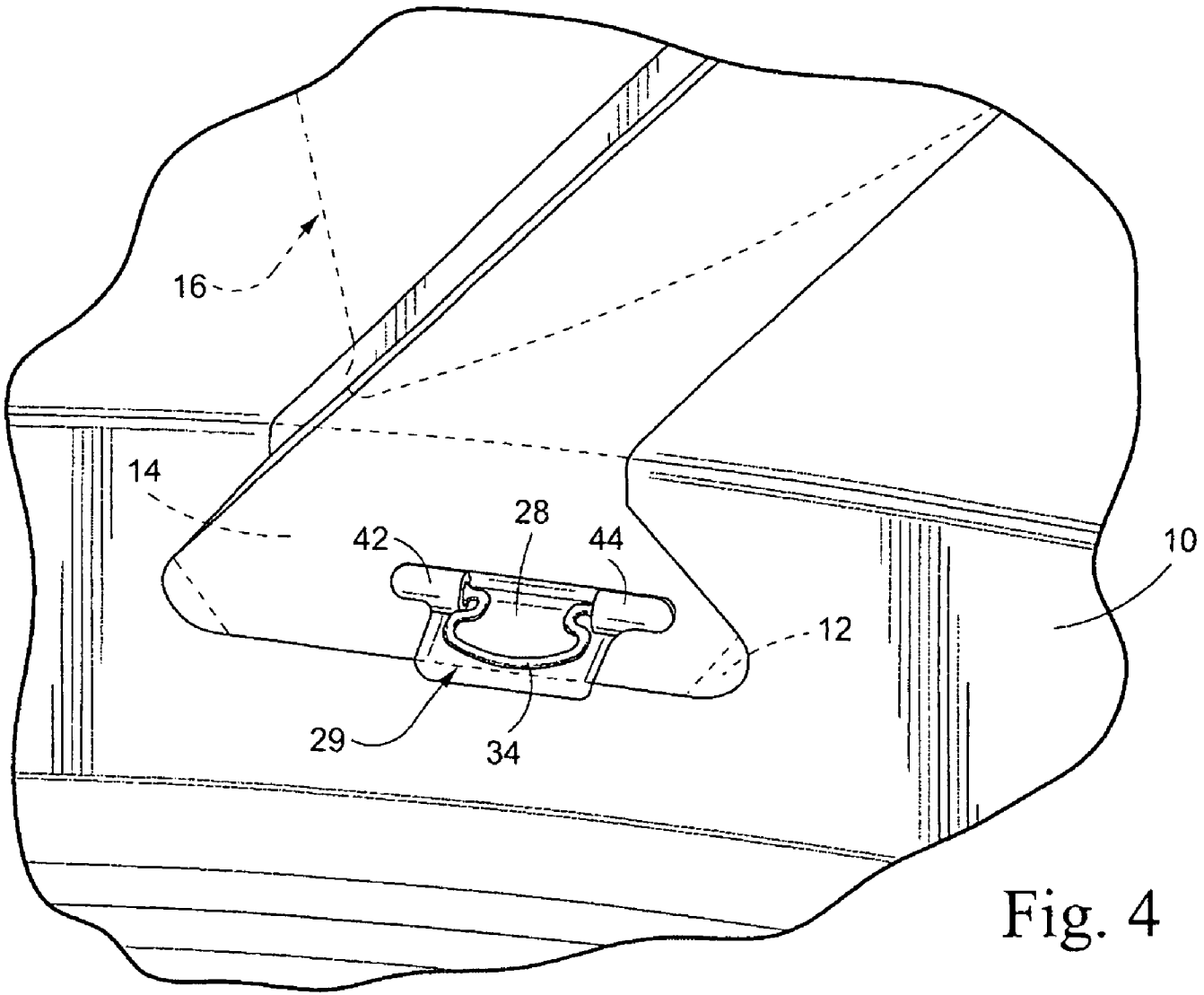
FIG. 4 is a partial perspective view, also partially in phantom showing the retention clip inserted in aligned T-shaped grooves in the rotor blade dovetail and rotor wheel dovetail slot.
Figure 5:
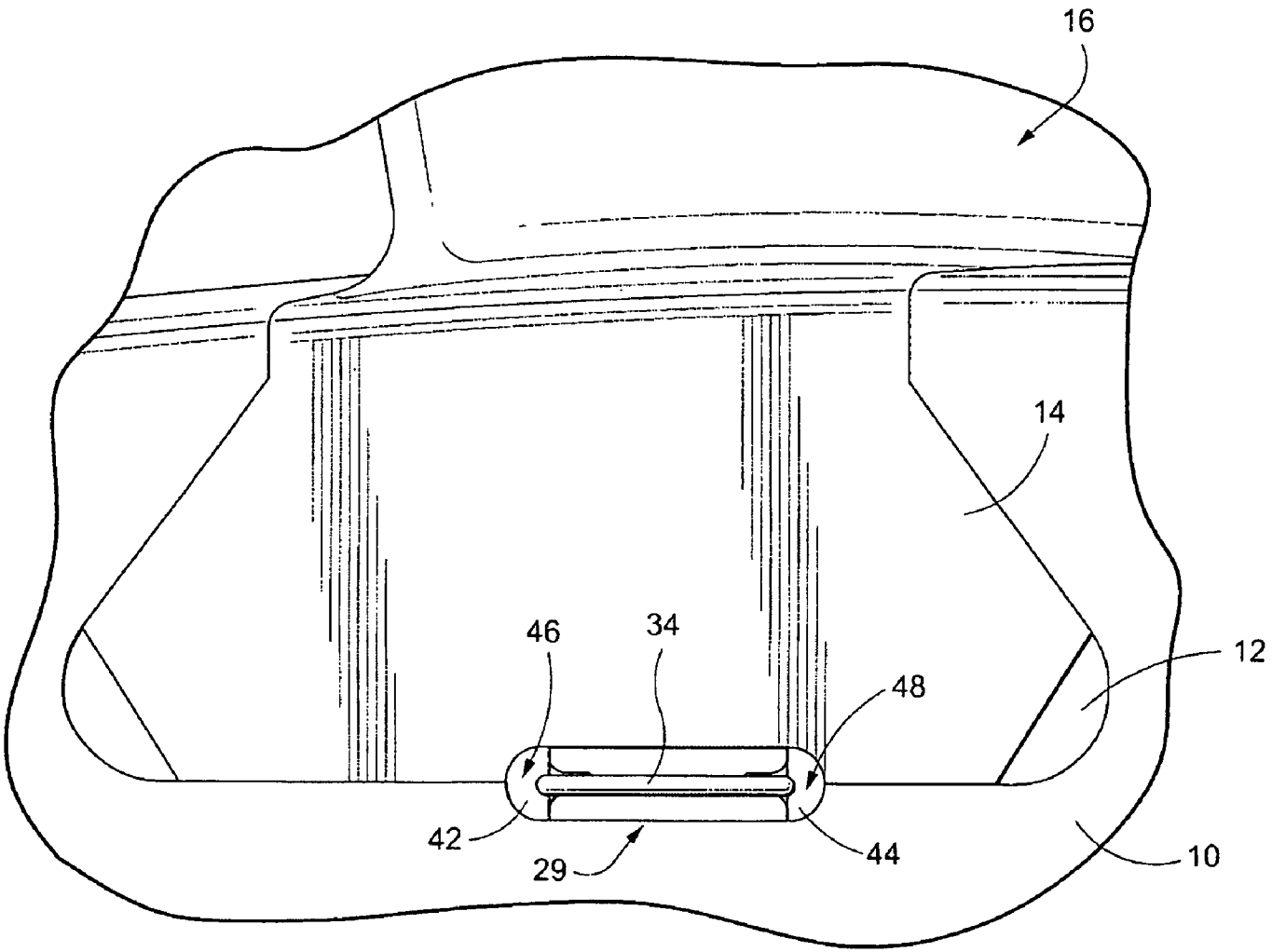
FIG. 5 is an end view of the components shown in FIG. 4.

FIG. 3 illustrates the substantially C-shaped spring clip 32, formed of a solid high strength steel (or other suitable alloy such as, e.g., inconel) of substantially circular (or other suitable) cross-section. The clip 32 is formed with a relatively wide loop portion 34 and a narrow neck portion 36, with remote axially aligned ends 38, 40 supporting oppositely extending lugs 42, 44, respectively, of increased diameter. The loop portion 40 extends in a compound arc from the narrow neck portion 36 and imparts a high degree of flexibility or compressibility to the clip. The clip is adapted to be inserted into the T-shaped slot 29, with the lugs 42, 44 seated in mating opposite ends of the lateral cross portions 22, 30 of the T-shaped slot, and the loop portion 34 received within the stem portions 20, 28 of the aligned grooves, as shown in FIG. 4. Note that sufficient gaps 46, 48 are is provided between the walls of the apertures 28 stem portion and the clip to permit insertion of a pliers or similar tool. More specifically, the spring clip 32 is laterally compressible so that the tool may be used to compress the clip to the extent that lugs 42, 44 move toward each other, permitting insertion and removal of the clip from the slot. When released after insertion, the lugs 42, 44 are resiliently spring-biased into engagement with the opposite ends of the lateral cross portion. This procedure can be done without damage to either the rotor wheel or the rotor blade.

The respective T-shaped clip grooves 18, 24 in the dovetail slot and dovetail may be centered or offset relative to a centerline along the dovetail groove bottom. In addition, the T-shaped clip grooves 18, 24 may be coaxial with the centerline or angled relative thereto. Offset or angled arrangements may be used as a "mistake-proof" feature to insure proper assembly.

It will be appreciated that the clip 32 may have other suitable cross-sectional shapes that allow the clip to be compressed for insertion and/or removal. Similarly, the shape of the lugs 42, 44 and the configuration of the loop portion 34 may also vary as desired, subject to the functional requirements of the clip. The lugs 40, 44 may be press fit, welded, brazed or otherwise suitably secured to the clip 32 or in the alternative, integrally formed and machined to proper size and shape.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An axial retention system for restraining axial movement of a machine component having a dovetail within a complimentary-shaped dovetail slot comprising:

a first substantially T-shaped groove formed in a bottom surface of said dovetail slot;

a second substantially T-shaped groove formed in a bottom surface of said dovetail, said first and second grooves in alignment when said dovetail is located within said dovetail slot to thereby form a closed periphery substantially T-shaped slot having a stem portion and a lateral cross portion at one end of the stem component, wherein the other end of the stem is open; and a compressible locking clip adapted for insertion within said substantially T-shaped slot, said locking clip having a pair of oppositely extending lugs receivable in opposite ends of said lateral cross portion.

2. The system of claim 1 wherein at least said opposite ends of said lateral cross portion are substantially circular in cross section.

3. The system of claim 2 wherein said stem portion is substantially rectangular in cross section.

4. The system of claim 1 wherein said oppositely extending lugs are connected by a flexible, substantially C-shaped loop portion.

5. The system of claim 4 wherein said clip is sufficiently flexible and sized to allow compression of said loop portion such that said oppositely extending lugs can pass through said stem portion and expand into said opposite ends of said lateral cross portion of said slot.

6. The system of claim 4 wherein said loop portion includes a narrow neck portion, with remote ends extending from said narrow neck portion and connected to said oppositely extending lugs.

7. The system of claim 6 wherein said stem portion has a width greater than said loop portion, leaving a gap sufficient to receive ends of a compression tool used to insert said clip into said groove.

8. The system of claim 1 wherein said first and second T-shaped grooves are aligned on a center axis along said dovetail slot.

9. An axial retention system for restraining axial movement of a turbine blade having a dovetail within a complimentary-shaped dovetail slot in a turbine rotor wheel comprising:

a first substantially T-shaped groove formed in a bottom surface of said dovetail slot;

a second substantially T-shaped groove formed in a bottom surface of said dovetail, said first and second grooves in alignment to thereby form a closed periphery substantially T-shaped slot having a stem portion and a lateral cross portion at one end of the stem component, wherein the other end of the stem is open; and a compressible locking clip inserted within said substantially T-shaped slot, said locking clip having a pair of oppositely extending lugs received in opposite ends of said lateral cross portion.

10. The system of claim 9 wherein at least said opposite ends of said lateral cross portion are substantially circular in cross section.

11. The system of claim 10 wherein said stem portion is substantially rectangular in cross section.

12. The system of claim 9 wherein said oppositely extending lugs are connected by a flexible, substantially C-shaped loop portion.

13. The system of claim 9 wherein said clip is sufficiently flexible and sized to allow compression of said loop portion such that said oppositely extending lugs can pass through said stem portion and expand into said opposite ends of said lateral cross portion.

14. The system of claim 9 wherein said loop portion includes a narrow neck portion, with remote ends extending from said narrow neck portion and connected to said oppositely extending lugs.

15. The system of claim 9 wherein said stem portion has a width greater than said loop portion, leaving a gap sufficient to receive ends of a compression tool used to insert said clip into said groove.

16. The system of claim 9 wherein said first and second T-shaped grooves are aligned on a center axis along said dovetail slot.

17. An axial retention system for restraining axial movement of a turbine blade having a dovetail within a complimentary-shaped dovetail slot in a turbine rotor wheel comprising:

a first substantially T-shaped groove formed in a bottom surface of said dovetail slot;

a second substantially T-shaped groove formed in a bottom surface of said dovetail, said first and second grooves in alignment to thereby form a closed periphery substantially T-shaped slot having a stem portion and a lateral cross portion at one end of the stem portion, wherein the other end of the stem is open;

a compressible locking clip inserted within said substantially T-shaped slot, said locking clip having a pair of oppositely extending lugs, connected by a substantially C-shaped loop portion and received in opposite ends of said lateral cross portion; and wherein said compressible locking clip is sized to allow compression of said loop portion such that said oppositely extending lugs can pass through said stem portion and expand into said opposite ends of said lateral cross portion.

18. The system of claim 17 wherein said oppositely extending lugs are connected by a flexible, substantially C-shaped loop portion.

19. The system of claim 18 wherein said loop portion includes a narrow neck portion, with remote ends extending from said narrow neck portion and connected to said oppositely extending lugs.

20. The system of claim 19 wherein said stem portion has a width greater than said loop portion, leaving a gap sufficient to receive ends of a compression tool used to insert said clip into said groove.

* * * * *